US010800201B2

(12) United States Patent
Zernicek et al.

(10) Patent No.: US 10,800,201 B2
(45) Date of Patent: Oct. 13, 2020

(54) SECURITY OBJECT HAVING A DYNAMIC AND STATIC WINDOW SECURITY FEATURE AND METHOD FOR PRODUCTION

(71) Applicants: BUNDESDRUCKEREI GMBH, Berlin (DE); BUNDESREPUBLIK DEUTSCHLAND, VETRETEN DURCH DAS BUNDESMINISTERIUM DES INNERN, VERTR. D. DAS BUNDES, Wiesbaden (DE)

(72) Inventors: Simone Zernicek, Berlin (DE); Andreas Bosien, Koenigs Wusterhausen (DE); Michael Knebel, Berlin (DE); Andre Leopold, Berlin (DE); Uwe Seidel, Schlangenbad (DE); Ulrich Schneider, Taunusstein (DE)

(73) Assignees: Bundesdruckerei GmbH, Berlin (DE); Bundesrepublik Deutschland, vertreten durch das Bundesministerium des Innern, vertreten durch das Bundeskriminalamt, Wiesbaden (DE)

( * ) Notice: Subject to any disclaimer, the term of this patent is extended or adjusted under 35 U.S.C. 154(b) by 0 days.

(21) Appl. No.: 16/082,135

(22) PCT Filed: Mar. 3, 2017

(86) PCT No.: PCT/EP2017/055099
§ 371 (c)(1),
(2) Date: Sep. 4, 2018

(87) PCT Pub. No.: WO2017/149153
PCT Pub. Date: Sep. 8, 2017

(65) Prior Publication Data

US 2019/0283482 A1 Sep. 19, 2019

(30) Foreign Application Priority Data

Mar. 4, 2016 (DE) ..... 10 2016 203 609

(51) Int. Cl.
*B42D 25/351* (2014.01)
*B42D 25/425* (2014.01)
(Continued)

(52) U.S. Cl.
CPC ..... *B42D 25/351* (2014.10); *B42D 25/23* (2014.10); *B42D 25/24* (2014.10); *B42D 25/29* (2014.10);
(Continued)

(58) Field of Classification Search
CPC ..... B42D 25/351; B42D 25/24; B42D 25/45; B42D 25/324; B42D 25/29; B42D 25/41; B42D 25/23
(Continued)

(56) References Cited

U.S. PATENT DOCUMENTS 4,765,656 A * 8/1988 Becker ..... G06K 19/14 283/70
6,179,338 B1 * 1/2001 Bergmann ..... G06K 19/083 283/109
(Continued)

FOREIGN PATENT DOCUMENTS

AU 2015100387 B4 4/2015
CN 101120139 A 2/2008
(Continued)

*Primary Examiner* — Justin V Lewis
(74) *Attorney, Agent, or Firm* — Laurence A. Greenberg; Werner H. Stemer; Ralph E. Locher

(57) ABSTRACT

A security object has a document body. A lens array is formed on a top side and first information is stored in the document body. The optical detectability of the first information through the lens array is dependent on a detection direction. The document body has a top view section, in
(Continued)

which the document body has a material layer that is translucent or opaque, and adjacent thereto a window section, in which the document body is formed of a material transparent in volume between a top side and a bottom side. The lens array extends over part of the window section and over part of the top view section and spans a section boundary between the sections. The first information also is formed partially in the top view section and partially in the window section and, in the window section, laser-marked, static second information is stored in the document body.

17 Claims, 7 Drawing Sheets

(51) Int. Cl.

| | |
|---|---|
| ***B42D 25/342*** | (2014.01) |
| ***B42D 25/23*** | (2014.01) |
| ***B42D 25/24*** | (2014.01) |
| ***B42D 25/29*** | (2014.01) |
| ***B42D 25/324*** | (2014.01) |
| ***B42D 25/41*** | (2014.01) |
| ***B42D 25/45*** | (2014.01) |

(52) U.S. Cl.
CPC ..... *B42D 25/324* (2014.10); *B42D 25/342* (2014.10); *B42D 25/41* (2014.10); *B42D 25/425* (2014.10); *B42D 25/45* (2014.10)

(58) Field of Classification Search
USPC ..... 283/67, 70, 72, 74, 86, 94, 98, 109, 901
See application file for complete search history.

(56) References Cited

U.S. PATENT DOCUMENTS

| | | | |
|---|---|---|---|
| 7,370,807 | B2 | 5/2008 | Buursma et al. |
| 8,006,908 | B2 | 8/2011 | Bergmann et al. |
| 8,284,492 | B2 | 10/2012 | Crane et al. |
| 8,778,481 | B2 | 7/2014 | Kaule et al. |
| 8,861,055 | B2 | 10/2014 | Holmes et al. |
| 2006/0197337 | A1 | 9/2006 | Merry et al. |
| 2011/0298205 | A1 | 12/2011 | Pohjola et al. |
| 2017/0210161 | A1 | 7/2017 | Cape et al. |
| 2017/0217243 | A1 | 8/2017 | Thurailingam |

FOREIGN PATENT DOCUMENTS

| | | | |
|---|---|---|---|
| CN | 103380006 | A | 10/2013 |
| DE | 102008008044 | A1 | 8/2009 |
| DE | 102008031653 | A1 | 1/2010 |
| DE | 102010062046 | A1 | 5/2012 |
| DE | 102011004935 | A1 | 9/2012 |
| DE | 102012204340 | A1 | 9/2013 |
| DE | 102012204341 | A1 | 9/2013 |
| DE | 102012025262 | A1 | 6/2014 |
| DE | 102012025264 | A1 | 7/2014 |
| DE | 102014100532 | A1 | 7/2015 |
| DE | 102014015280 | A1 | 4/2016 |
| EP | 0216947 | A1 | 4/1987 |
| EP | 0219012 | B1 | 1/1993 |
| EP | 1507669 | B1 | 12/2005 |
| EP | 1698485 | A2 | 9/2006 |
| EP | 1853763 | A1 | 11/2007 |
| EP | 1697146 | B1 | 2/2012 |
| EP | 2373493 | B1 | 2/2013 |
| EP | 2559563 | B1 | 3/2014 |
| EP | 2897812 | A1 | 7/2015 |
| WO | 9415319 | A1 | 7/1994 |
| WO | 03022598 | A1 | 3/2003 |
| WO | 2005058610 | A2 | 6/2005 |
| WO | 2006087138 | A1 | 8/2006 |
| WO | 2007133613 | A2 | 11/2007 |
| WO | 2011051670 | A2 | 5/2011 |
| WO | 2013139748 | A1 | 9/2013 |
| WO | 2014044402 | A1 | 3/2014 |
| WO | 2016011249 | A2 | 1/2016 |
| WO | 2016015130 | A1 | 2/2016 |

* cited by examiner

SECURITY OBJECT HAVING A DYNAMIC AND STATIC WINDOW SECURITY FEATURE AND METHOD FOR PRODUCTION

BACKGROUND OF THE INVENTION

Field of the Invention

The invention relates to a method for producing a security object and a security object.

Here, a security object is considered to be a physical object which comprises a document body preferably produced from a plurality of materials, for example a composite body embodied as a lamination body, and which comprises at least one feature that makes production of a counterfeit, an imitation, a duplicate or the like more difficult or even impossible. Security objects are used, for example, for producing security and/or valuable documents or directly as security or valuable documents. By way of example, modern passport or identification documents often comprise a security object in the form of a security document body produced on a plastics basis. As a rule, such a security object is produced from a plurality of layers, for example films, of the same or different plastics materials. Such an object with a security feature is a security object.

To secure against falsification, unauthorized reproductions, duplicates and the like, security composite bodies or security documents have so-called security features. One class of security features has an observation-angle-dependent optical effect. Such observation-angle-dependent effects can be produced, for example, by diffracting structures such as holograms or refractive structures.

A subgroup of the security features having an angle-dependent optical effect comprises a light-refracting structure, for example in the form of a lenticular lens which comprises a multiplicity of lens elements in a lens array, and, at a distance therefrom, an information item stored in the document body, said information item being optically registrable.

WO 03/022598 A1 has disclosed a recording medium having an upper layer which has, on its outer side, a plurality of lenticular lenses and, on the back side, a presentation element which appears to be movable about at least one axis when tilting the recording medium. The lenticular lenses only extend over a portion of the entire outer side. The presentation element is a security element that is printed on an inner card layer. How the lenticular lenses are introduced into the document body is not disclosed.

WO 2005/058610 A2 has disclosed a data medium in which identifications in the form of patterns, letters, numbers and/or images have been introduced by a laser beam, said identifications being visible on account of local changes in the optical properties of the data medium resulting from material conversions and caused by the laser beam. The data medium comprises a laser-sensitive recording layer that is transparent in the visible spectral range, said recording layer being provided with a surface relief in the form of a lens grid. The identifications are introduced into the recording layer by means of the laser beam from different directions through the lens grid and identifiable from the same directions during a subsequent observation. The data medium is transparent, at least in the region of the introduced identifications.

WO 2011/051670 A2 has disclosed a security apparatus with a lens-like apparatus comprising an arrangement of lens-shaped focusing elements which is formed over an array of sets of images strips such that, under different observation directions, respectively one corresponding image strip of each set is visible through a corresponding lens-shaped focusing element, wherein the image strips are at least partly formed as a relief structure.

DE 10 2008 008 044 A1 has disclosed a cost-effective method for producing security and/or valuable documents, which are suitable to produce flexible and counterfeit-safe structures with low thermal loads, wherein the surface structure is imprinted into the upper side and/or the lower side of substrates used for producing documents by way of an imprinting device, which has at least one imprinting tool with respectively one contact face, under the application of an imprinting pressure and under the application of ultrasound, wherein the contact face is exactly as large as, or greater than, the upper side or the lower side of the substrate. Embodiments of the production method which imprint microlenses into a document body are described.

DE 10 2008 031 653 A1 has disclosed a method and an apparatus for introducing a security feature into a valuable or security document, wherein the valuable or security document comprises a document body with at least one thermoplastic surface layer, wherein the method includes the steps of: providing the document body; providing and/or creating a structured sonotrode, which is, or has been, coupled to a sound source; arranging the document body relative to the sonotrode; bringing the sonotrode and the surface layer of the document body into contact and simultaneously input coupling sound waves into the valuable or security document via the sonotrode such that a relief structure forms in the surface layer, wherein the sonotrode is provided and/or produced with structuring, which has an intended penetration plane, and the sonotrode is structured in such a way that regions projecting from the intended penetration plane and lowered regions protruding into the intended penetration plane exist, wherein the sonotrode is moved into the document body during the input coupling of sound under the application of pressure until the intended penetration plane corresponds to an intended document body surface level and the projecting regions produce lowered relief structures and the lowered regions produce projecting relief structures in the surface layer.

EP 0 216 947 A1 has disclosed a card-shaped data medium with a substrate and at least one transparent capping film. The substrate is provided with information items that are identifiable through the capping film under the application of a laser beam, wherein the transparent capping film carries a relief that at least partly overlaps the information item region and that was applied before recording the information item, said relief modifying the information item recording in a characteristic fashion by way of its optical lens effect. Depending on the incoming beam direction of the laser light, the information item is stored at different locations in the substrate. Likewise, different information items are perceived during a visual inspection, depending on an observation angle.

EP 0 219 012 B1 has disclosed a data medium in which information items are introduced in an internal volume region by means of a laser beam, said information items being visible in the form of changes of the optical properties on account of an irreversible material change caused by the laser beam. By way of example, card-shaped data media, which have a lens grid at a surface, are described. The lens grid can be imprinted during a lamination process, by virtue of a negative of the lens grid being worked into a corresponding lamination plate. It is likewise possible to use a thermostable imprinting matrix which is inserted between the transparent capping layer and the laminating plate. There are further descriptions to the effect of the card being able to be produced by means of a lamination method and the lens grid subsequently being introduced by means of an imprinting stamp or an imprinting roller. The information item is introduced by way of a laser beam which introduces information items through the lens grid into the card body from different directions. Thus, tilting images can be realized in a simple manner.

In general, there is a need for developing ever newer security features, in particular those which are difficult to produce and consequently cannot be reproduced by counterfeiters or can only be reproduced with significant outlay. Nevertheless, it should be possible to easily and reliably check these, preferably without further aids, for the presence and/or the authenticity and intactness thereof.

SUMMARY OF THE INVENTION

Consequently, the invention is based on the technical problem of developing a method for producing a novel security object and a novel security object, which comprises an observation-angle-dependent security feature and which is more difficult to produce than security objects known from the prior art, in particular in the form of security document bodies formed as composite bodies.

The invention is based on the concept of producing a security object with a document body having a window portion, in which the document body is produced from a material that is transparent in volume. Additionally, the document body has a reflected view portion, in which looking through the document body is prevented by a material layer that is translucent or opaque in volume. This reflected view portion immediately adjoins the window portion. Between the upper side and the translucent or opaque material layer, the document body is formed transparent in volume in the reflected view portion such that graphic information items formed on the translucent or opaque material layer or information items stored in the volume between the translucent or opaque material layer and the upper side are registrable through the upper side in the case of a reflected view observation. A novel security element comprises a lens array which extends over both at least part of the window portion and at least part of the reflected view portion and, as a result thereof, bridges a portion boundary between the reflected view portion and the window portion. In the document body, a laser-marked and registration-direction-dependent first information item, which is stored in the document body by way of first irreversible material changes, is formed partly in the reflected view portion and partly in the window portion. Additionally, a laser-marked and static second information item is stored in the window portion by way of second irreversible material changes in the document body, wherein the second information item is registrable optically as a static information item both through the lens array at or in the upper side of the document body and through the lower side of the document body. What this means is that the second information item is registrable through the upper side independently of the observation direction relative to the upper side of the document body and also, accordingly, through the lower side independently of the observation direction relative to the lower side of the document body. Since an optical registrablity is independent of the observation direction, this second information item is referred to as a static information item.

Such a security object is preferably produced using a method comprising the steps of: providing or producing a document body with a planar extent, said document body having an upper side and an opposite lower side, wherein a lens array is formed, or has been formed, at or in the upper side, and storing a first laser-marked registration-direction-dependent information item by virtue of spatially modulated light being radiated through the lens array from one direction and first irreversible material changes being caused in focal regions of the lenses of the first lens array. Provision is made for the document body to be provided or formed with a reflected view portion, in which the document body has a material layer that is translucent or opaque in volume between the upper side and the lower side of the document body and with a window portion adjoining the reflected view portion, the document body being formed in said window portion from material that is transparent in volume between the upper side and the lower side of the document body, and with the lens array, wherein the lens array extends over both at least part of the window portion and at least part of the reflected view portion and, as a result thereof, bridges a portion boundary between the reflected view portion and the window portion, and storing the first information item to be implemented in such a way that the laser-marked and registration-direction-dependent first information item, too, is formed partly in the reflected view portion and partly in the window portion and, additionally, further spatially modulated light is radiated into the window portion through the lower side of the document body and a static second information item is laser-marked and stored in the document body by way of second irreversible material changes, wherein the second information item is optically registrable as a static information item both through the lens array at or in the upper side of the document body and through the lower side of the document body. The security object developed thus, with a document body or in the form of a security document body, provides an easy-to-verify security feature. Firstly, there is a first information item, which is registrable or not registrable depending on observation direction and, additionally, there is a second information item which can be identified statically, i.e., in direction-independent fashion, in each case, both during an observation through the upper side and during an observation through the lower side.

Such a security object is already difficult to counterfeit for the reason that a window filled with material that is transparent in volume has to be worked into a material layer that is translucent or opaque in volume. Moreover, the first information item should be formed in such a way that it extends both over the window portion and the reflected view portion. In addition thereto, the second information item should be integrated into the document body as a static information item.

Definitions

A security object refers to a physical entity having at least one security feature which makes imitations, unauthorized duplications, counterfeiting or the like more difficult or impossible or which facilitates a check for authenticity and intactness of the security object. A security object can be a security document such as a personal identification, a driver's license, an ID card, a bankcard, etc. Likewise, however, a security object can also be a semifinished product, such as a passport card which is, or has been, inserted into a security document such as a passport, for example.

A body is considered to have a planar extent if its upper side and lower side have an extent that is substantially greater than the distance between the opposing upper and lower side. This means that a side edge or a straight line bisecting the area of the upper side exists, which is longer than the distance of the upper and lower side from one another. Common security document formats in particular, e.g., ID1 and ID3 formats, supply document bodies with a planar extent. All card-shaped conventional security document bodies are document bodies with a planar extent.

A material is referred to as transparent if light propagation therethrough is possible according to geometric optics. This means that no noteworthy diffuse scattering occurs in the volume of the material but, instead, the light propagates in a straight line in the volume according to conventional optics. A material that is transparent in volume which does not have the aforementioned property for all wavelengths in the visible spectrum may also be included. However, the aforementioned property must be present for at least one wavelength range. Window glass or else non-stained plastics made out of polycarbonate, polyethylene, PVC or other thermoplastic plastics can be formed as materials that are transparent in volume.

A material is referred to as translucent in volume if a straight-lined light propagation, as would take place according to geometric optics, is prevented by diffuse scattering in the volume.

A material is referred to as opaque if there is a noteworthy attenuation of a transmission of light in the visible wavelength range. This property, overall, depends on the layer thickness of the opaque material. By way of example, typical 80 $g/m^2$ paper, plastics stained in the volume, reflecting metal layers and the like are considered to be opaque. All layers which attenuate a transmission of light in the visible wavelength range by at least 50% in the case of a layer thickness of 10 μm are considered to be opaque with absorbing dies.

A lens array refers to an arrangement of a multiplicity of lens elements. Preferably, a lens array consists of lens elements of the same kind. However, embodiments in which the individual lens elements have different embodiments in groups or else individually are also possible. Preferably, a lens array has a multiplicity of cylindrical lens elements that are aligned parallel to one another and that immediately adjoin one another.

Here, an irreversible material change is considered to be a material change in the volume of the document body which is registrable optically, in particular for a human but also for an optical registration apparatus such as a digital camera. Preferably, irreversible material changes are formed as blackenings or differently formed scattering centers in volume-transparent material.

An observation direction or incoming beam direction, which relates to a document body, is set or describable by a solid angle relative to the surface normal of the upper side of the document body or relative to the surface normal of the lower side of the document body.

A reflected view portion refers to a portion or region of a document body in relation to the upper side or lower side thereof, in which a view through the document body is curtailed by at least one opaque or translucent material layer arranged in the document body and in which, in the case of an observation in a plan view through the upper side or lower side, it is only possible to register the information items which are arranged in transparent material between the upper side or lower side and the at least one translucent or opaque material layer or on the surface thereof facing the upper side or lower side. If the document body comprises a plurality of translucent or opaque material layers, the material layers facing the upper side or lower side, respectively, are decisive and bound the storage region of the information item registrable in a plan view.

A window portion is considered to be that portion in relation to the upper side of the document in which a view through the document body is possible on account of the formation of material that is transparent in volume between the upper side and the lower side of the document body.

A document body is a physical object provided for forming a security document. If said document body has a security feature, it is also referred to as a security document body. Since the document bodies described here are provided for forming a security object, reference is sometimes also made to a security document body without explicitly discussing a security feature. Since, as a rule, document bodies have a multiplicity of security features, reference is sometimes also made to a security document body at which the security feature or features described explicitly here is or are not yet completely formed. Then, a security document body is used synonymously as a document body. A substrate layer refers to a layer that can be handled independently. A film of plastics material is referred to as a substrate layer. The layers from which a lamination body is assembled are referred to as substrate layers here.

Here, a material layer refers to a layer with substantially uniform material properties in a document body. As a rule, a material layer emerges from a substrate layer during a lamination process. Consequently, as a rule, there is a correspondence between a material layer and a substrate layer existing prior to lamination. Within the meaning of this correspondence, the terms of substrate layer and material layer can be used as synonyms.

Preferred Embodiments

In particular, a security object having a document body with a planar extent is developed, having an upper side and an opposite lower side, wherein a lens array is formed in the upper side of the document body and a laser-marked and registration-direction-dependent first information item is stored in the document body by way of first irreversible material changes in the document body, the optical registrability thereof through the lens array depending on a registration direction, wherein the document body has a reflected view portion, in which the document body has between the upper side and the lower side of the document body a material layer that is translucent or opaque in volume, and comprises a window portion adjoining the reflected view portion, in which window portion the document body is formed from material that is transparent in volume between the upper side and the lower side of the document body, and the lens array extends over both at least part of the window portion, and at least part of the reflected view portion and, as a result thereof, bridges a portion boundary between the reflected view portion and the window portion, and the laser-marked and registration-direction-dependent first information item, too, is embodied partly in the reflected view portion and partly in the window portion and, additionally, a laser-marked and static second information item is stored in the window portion by way of second irreversible material changes in the document body, wherein the second information item is registrable optically both through the lens array at or in the upper side of the document body and through the lower side of the document body.

Further, a method for producing a security object is developed, said method comprising the steps of:

providing or producing a document body with a planar extent, said document body having an upper side and an opposite lower side, wherein a lens array is formed, or has been formed, at or in the upper side, and storing a first laser-marked registration-direction-dependent information item by virtue of spatially modulated light being radiated through the lens array from one direction and first irreversible material changes being caused in focal regions of the lenses of the lens array, wherein the document body is provided or formed with a reflected view portion, in which the document body has a material layer that is translucent or opaque in volume between the upper side and the lower side of the document body, and with a window portion adjoining the reflected view portion, the document body being formed in said window portion from material that is transparent in volume between the upper side and the lower side of the document body, and with the lens array, wherein the lens array extends over both at least part of the window portion and at least part of the reflected view portion and, as a result thereof, bridges a portion boundary between the reflected view portion and the window portion, and storing the first information item is implemented in such a way that the laser-marked and registration-direction-dependent first information item, too, is formed partly in the reflected view portion and partly in the window portion and, additionally, further spatially modulated laser light is radiated into the window portion through the lower side and a static second information item is laser-marked and stored in the document body by way of second irreversible material changes, wherein the second information item is optically registrable both through the lens array at or in the upper side of the document body and through the lower side of the document body.

The second information item is registrable through the lens array independently of the observation direction.

It was found to be advantageous to choose the first and the second information item in such a way that these complement one another to form an overall information item. This can bring about securing of the individual information items, respectively by way of the other information item.

In one embodiment, provision can be made for the second information item to comprise a letter, a sequence of letters, a word, a digit or a sequence of digits which supplies the overall information item when inserted into the first information item.

Preferably, the overall information item has a meaning which is identifiable by a human observer or a verification apparatus and which only emerges from the combination of the first information item and the second information item to form the overall information item.

The second information item may also be derivable from the first information item. To this end, e.g., a hash function or the like may be desired. If the hash function is known, the second information item can be calculated from the first information item. Consequently, it is possible to check whether the first information item and the second information item are correctly "linked" to one another by way of the hash function. If this test result is negative, a counterfeit can be deduced.

In order to simplify the verifiability of the overall information item, provision is made for the overall information item to be stored in the document body as a reference information item for reference purposes, in addition to the first information item and the second information item, which are each stored in the document body by way of irreversible material changes. By way of example, this storage can be implemented by printing technology. It is likewise possible to electronically store this information item in a microchip, which is integrated in the document body, or in a hologram or the like.

The document body is formed, at least in part, preferably as a whole, as a lamination body. The latter is produced by virtue of a plurality of substrate layers being brought together in a substrate layer stack and being connected to one another in a planar fashion by the introduction of energy in a lamination step, wherein a substrate layer that is translucent or opaque in volume is arranged in the substrate layer stack, said substrate layer that is translucent or opaque in volume forming the translucent or opaque material layer of the document body, wherein the substrate layer that is transparent or opaque in volume has a cutout in a region which corresponds to the window portion, said cutout being filled with a transparent material before or during the lamination step. The individual employed substrate layers can be provided with further security features, in particular with security prints or else perforations or the like, prior to the lamination.

Preferably, the lens array at or in the surface of the document body is imprinted into the upper side of the lamination body by means of a lamination stamp during the lamination step.

Alternatively, the lens array can be formed by imprinting by means of an ultrasound sonotrode or in an other way, for example by means of laser ablation, after the lamination.

In order to simplify laser marking and in order to be able to easily localize the irreversible material changes, a laser-sensitive transparent material layer is preferably formed in the document body, the focal positions of the lens elements of the lens array being situated in the volume of said laser-sensitive transparent material layer. A laser-sensitive material layer consists of a transparent material containing substances that locally promote laser absorption without causing a noteworthy impairment of the transparency. This means that blackening occurs at a lower energy density of the introduced laser light in laser-sensitive layers than in the case of a laser-insensitive layer that otherwise consists of identical plastics material.

In a development of the invention, the document body has a further or second laser-sensitive material layer that differs from the one or first laser-sensitive material layer and that is preferably spaced apart from the latter. Said further or second laser-sensitive material layer is situated between the first laser-sensitive material layer and the lower side of the document body. Particularly preferably, said further or second laser-sensitive material layer is arranged between the lower side and the translucent or opaque material layer. In such an embodiment, the second static information item is preferably marked in the second laser-sensitive layer.

If the first and the second laser-sensitive layer are spaced apart from one another in the document body, it is possible to identify that the first information item and the second information item are not stored in the same plane when the first information item and the second information item are observed more closely, at least when tilting the document body or when there is a change in the registration direction caused in another way. This creates a further effect that is difficult to imitate, it being possible to use said effect to verify the authenticity of the document body or the security object.

Only if it is possible to determine that the first and the second information item are stored in different planes of the document body is a document body verified as authentic in this embodiment.

Particularly preferably, the first and the second information item are matched to one another in such a way that the second information item is arranged relative to the first information item in space in such a way that the overall information item can be registered correctly. By way of example, the overall information item may consist of an alphanumeric character sequence, wherein at least one character in the middle of the character sequence is formed by the second information item. For verification purposes, it is possible to use both the correct alignment in respect of the distance of the characters from one another along the character string, i.e., in the reading direction, and a correct alignment of the character formed by the second information item across the reading direction relative to the remaining characters, and also a character size, etc.

Embodiments in which the second information item or at least a constituent part of the second information item, for example at least one alphanumeric character, is arranged immediately adjacent to a portion boundary between the reflected view portion and the window portion were found to be particularly hard to counterfeit. Here, a distance of the constituent part of the second information item from the portion boundary is preferably smaller than a mean character width of the alphanumeric characters forming a character string of the overall information item.

Particularly if a center of the lens array does not coincide with an axis of symmetry of the front side of the document body and, however, an incoming beam direction of the laser radiation employed for storing the direction-dependent first information item is set by way of a tilt of the document body through an axis that coincides with such an axis of symmetry of the document body, it is necessary to adapt according to the distance of the lens array from the tilt axis of the document body and according to the tilt angle the graphic information item, which is impressed by spatial modulation with the laser light, to the distortion caused thereby in relation to a plane projection onto the upper side of the document body.

Since imprinting the lens array and the specific position of the portion boundary may vary on account of manufacturing tolerances and handling tolerances of the document body when marking, provision is made in a preferred embodiment for a position of a portion boundary between the window portion and the reflected view portion to be established relative to a reference unit of a marking apparatus and for the spatial modulation and/or positioning of the incoming radiation of the first laser light to be implemented on the basis of the established position of the portion boundary. Establishing this portion boundary is also of decisive importance for the introduction of the second information item.

However, as a rule, the document body is turned over once prior to marking through the lower side. In order to precisely know the position of the portion boundary, the portion boundary is registered again prior to introducing the second information item in a preferred embodiment and the results of the second establishment of the position of the portion boundary are used for the spatial modulation and/or positioning of the laser light for introducing the second information item.

In a development of the invention, which brings about an even more precise reproduction of the first stored information item, the position of the lens array relative to the reference unit of the marking apparatus is additionally also established for the purposes of introducing the first information item. This is preferably brought about by virtue of an image of the upper side of the document body being registered, for example by means of a digital camera, while the upper side is illuminated with light under grazing incidence. In the registered image, the region of the lens array is clearly identifiable by way of the contrast in relation to the surrounding surface of the upper side.

The position of the portion boundary is preferably established by way of registering an image of the document body from the upper side or from the lower side of the document body, preferably in a direct plan view, with illumination being brought about from the opposite side of the document body in each case such that a transmitted-light image is registered. The portion boundary is registrable as a contrast boundary in the image. By way of example, the registration apparatus represents the reference device of the marking apparatus. The laser is preferably arranged rigidly in relation thereto.

BRIEF DESCRIPTION OF THE SEVERAL VIEWS OF THE DRAWING

Further advantages of the invention emerge from the following description of the figures. In the figures.

DESCRIPTION OF THE INVENTION

Figure 1:
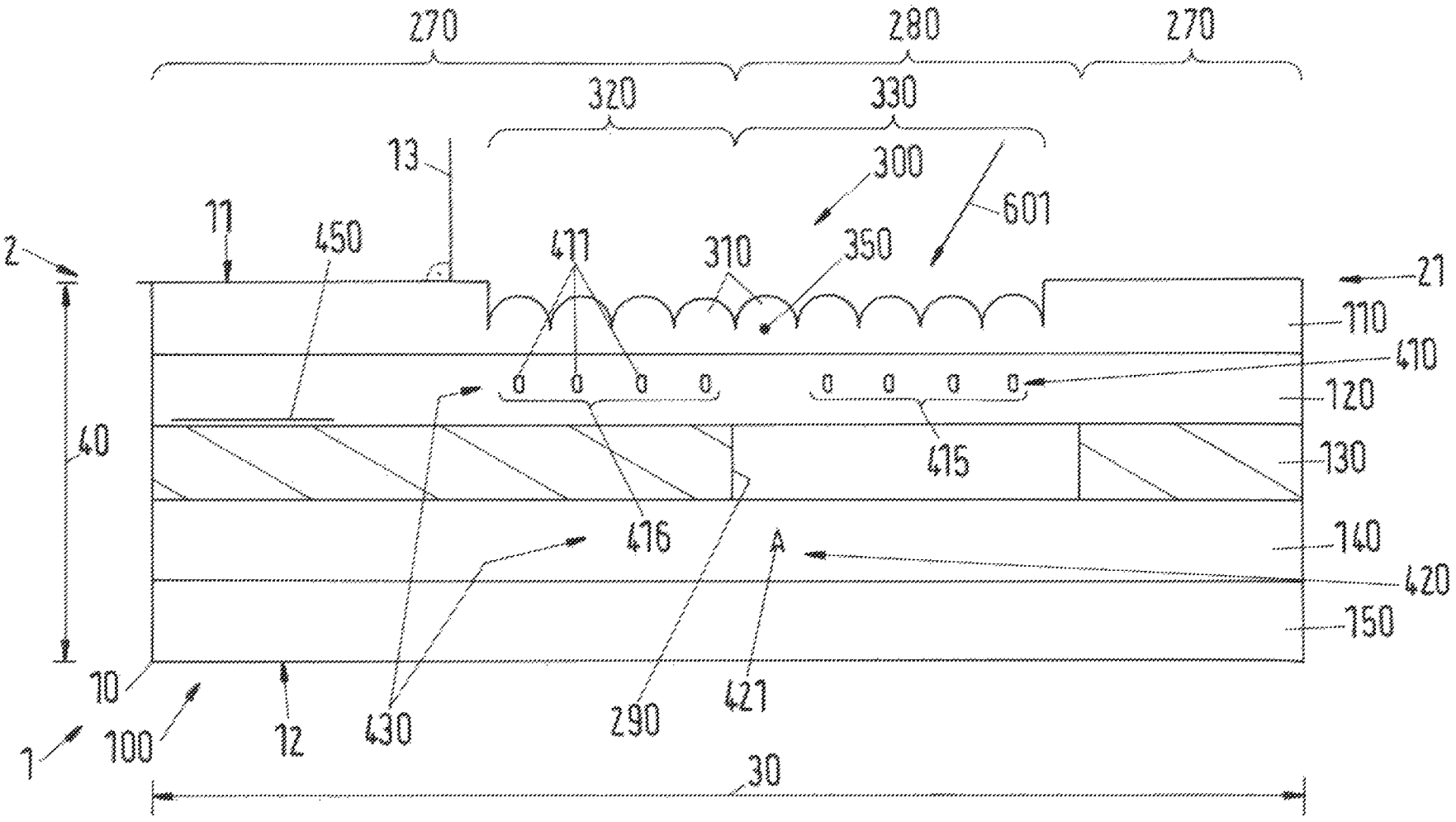
FIG. 1 shows a schematic sectional view through a security object embodied as a security document.

FIG. 1 schematically shows a sectional view through a security object 1 embodied as a security document 2. The security document 2 comprises a document body 10. In the illustrated embodiment, said document body is embodied as a lamination body 100. The document body 10 has an upper side 11 and an opposite lower side 12. The document body 10 has a planar embodiment, meaning that an edge length 30 of the upper side 11 is greater than a distance between the upper and the lower side, i.e., a document body thickness 40, preferably by an order of magnitude.

This is tantamount to an area of the upper side 11 or an area of the lower side 12 having an extent along a direction, for example the edge length 30 or a straight path bisecting the area, which is greater than the document body thickness 40, preferably by at least one order of magnitude.

In the illustrated embodiment, the document body 10 is formed from five material layers from the upper side 11 to the lower side 12, which material layers are brought together to form the lamination body 100 in a lamination method. From the upper side 11 to the lower side 12, these are a transparent material layer 110, a first laser-capable transparent material layer 120, an opaque material layer 130 with a cutout 135, which is filled with a transparent material 136, a second laser-capable substrate layer 140 and a further transparent layer 150. Other embodiments may have a deviating number of material layers. What is essential is that at least one material layer in the volume is opaque and said layer has a cutout that is filled with a transparent material. In this region or portion, all material layers arranged thereabove and therebelow are embodied to be transparent in volume.

The document body 10 has a window portion 280, in which all material layers 110 to 150 between the upper side 11 and the lower side 12 are embodied to be transparent in volume. Additionally, the document body 10 has a reflected view portion 270, in which a material layer, the material layer 130 in the illustrated embodiment, has an embodiment that is opaque in volume. Consequently, in the reflected view portion 270, only the information item stored on or above the opaquely embodied material layer 130 in the reflected view portion 270 can be registered in the case of an observation or optical registration of an image of the document body 10 through the upper side 11. By contrast, information items stored in the entire volume between the upper side 11 and the lower side 12 in the region of the window portion 280 are also registrable in the window portion 280. The window portion 280 and the reflected view portion 270 immediately adjoin one another along a portion boundary 290.

The document body 10 further comprises a microlens array 300 which has a multiplicity of lens elements 310. In the illustrated embodiment, the lens array 300 has a multiplicity of cylindrical lens elements 310 of the same design. In one part 320, the lens array 300 extends over the reflected view portion 270 and, in another part 330, it extends over the window portion 280 of the document body. Consequently, the lens array 300 extends over a portion boundary 290 between the reflected view portion 270 and the window portion 280.

Here, the terms upper side 11 and lower side 12 in respect of the document body 10 are always selected in such a way that the microlens array 300 is formed at or in the upper side 11 of the document body 10. The terms provide no information in view of a subsequent use. Consequently, the side essential to use may also be the side of the document body 10 referred to here as lower side 12.

Additionally, an observation- or registration-direction-dependent first information item is stored in the document body 10. This storage is implemented in the document body 10 by way of first irreversible material changes 411. In the illustrated figure, these are schematically illustrated by the lowercase "a" in each case. By way of example, storage is implemented by virtue of the first information item being radiated into the security document through the lens array along a direction 601, which also corresponds to an observation direction for identifying the first information item.

The material thicknesses of the transparent material layer 110 and of the first laser-capable material layer 120 are preferably selected in such a way that focal positions of the lens elements 310 of the lens array 300 lie in the first laser-sensitive material layer 120. By way of example, laser light is radiated through a spatial light modulator when marking, said spatial light modulator being able to be formed as a unit of liquid-crystal cells with polarization filters, for example. The spatially modulated light is focused into focal positions in each case by the lens elements 310 of the microlens and chosen in terms of the intensity in such a way that irreversible material changes, e.g., blackenings, are implemented in the focal positions. Since the blackenings are only brought about in the focal points, the stored first information item can be identified from the first direction 601. In the case of an observation from this direction 601, the blackenings formed in the focal points, which blackenings correspond to the first information item, are imaged for an observer again. By contrast, from other, deviating directions, other regions of the laser-sensitive material layer, at which no blackening is present, are imaged. Consequently, the first information item is stored in the document body 10 in an observation-direction—dependent manner.

Additionally, a second information item 420 is stored in the document body 10 by way of second irreversible material changes 421, which are represented by the uppercase "A". The second information item is formed as a static information item; i.e., it is stored in such a way that it is registrable from all observation directions through the upper side 11. This can be brought about by virtue of the second information item, for example, being introduced by way of a laser marking through the lower side 12 of the document body 10 into the latter. To this end, laser radiation is spatially modulated with the second information item and focused in such a way that the greatest energy density preferably occurs in the second laser-sensitive material layer such that the second information item is stored in the second laser-sensitive material layer 140 by way of the second irreversible material changes 421.

In a preferred embodiment, the first information item 410 and the second information item 420 are matched to one another in such a way that, from the one observation direction 601, from which the first information item 410 is registrable, the first information item 410 and the second information item 420 complement one another to form an overall information item 430. By way of example, the first information item could be "aaa" and the second information item could be "A". Then, the overall information item is "aaaAaaa". Here, the second information item 420 supplies a constituent part of the overall information item 430, which is fitted into the first information item 410 at a predetermined location. By way of example, the first information item 410 could consist of a numerical sequence "123 567" and the second information item could consist of the digit "4". Then, the overall information item is the numerical sequence "1234567". Expediently, the overall information item is consequently chosen in such a way that it has a meaning that can easily be checked by an observer. In order to simplify this, the information content of the overall information item can be formed a further time as a reference information item 450, for example as a print or laser marking, at another location in the security document for reference purposes.

In order to make counterfeiting more difficult, the first and the second information item are preferably positioned relative to one another in such a way that subsequent counterfeiting of constituent parts of the first or of the second information item is easily identifiable. By way of example, the first information item and the second information item are each formed from alphanumeric characters of the same character set and the same font size. The second information item comprises one or more alphanumerical characters which, in the case of an observation from the direction 601 from which the first information item is registrable, fit into said first information item in such a way that the characters are correctly aligned in relation to one another. Here, the first information item 410 in each case always extends both over the reflected view portion 270 and the window portion 280. This means that the first information item 410 has constituent parts 415 that are stored in the window portion 280 and constituent parts 416 that are stored in the reflected view portion 270. It is particularly hard to counterfeit embodiments in which at least one constituent part of the second information item is formed immediately adjacent to the portion boundary 290 such that said constituent part fits into the first information item, which is formed over the portion boundary 290.

Figure 2:
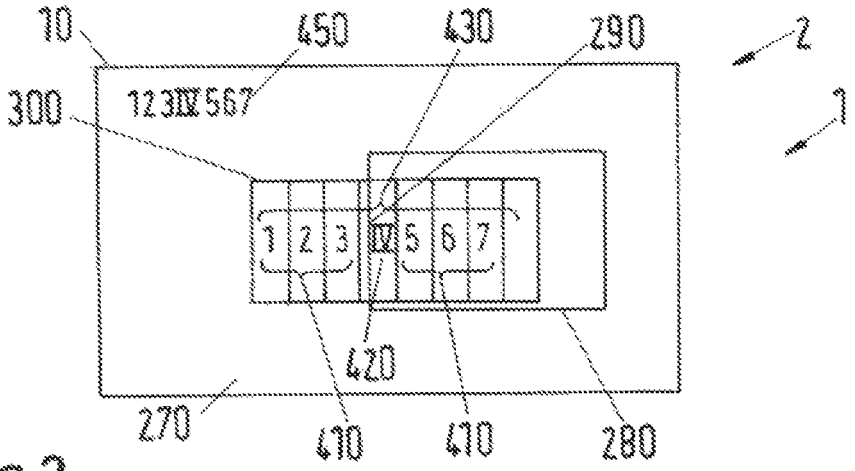
FIG. 2 shows a schematic plan view of a security object embodied as a security document.

FIG. 2 schematically illustrates a plan view of a security document 2 similar to the one according to FIG. 1. In all figures, the same technical features are denoted by the same reference signs. Here, the assumption is made that the first information item 410 is stored for a perpendicular observation into the document body 10 through the microlens array. This means that both the first information item and the second information item are visible in the case of a plan view. It is possible to recognize that the microlens array 300 is situated both partly over the reflected view portion 270 and partly over the window portion 280 and it bridges the portion boundary 290. Likewise, the first information item 410, "123 567", is partly formed in the reflected view portion 270 and partly in the window portion 280, and it consequently likewise bridges the portion boundary 290. The second information item 420, "IV", is inserted with accurate fit into the first information item 410, and so the first information item 410 and the second information item 420 complement one another to form the overall information item 430, "123IV567". The information content thereof is stored one more time as a reference information item 450 in the security document, for example as a laser engraving at a different location. The reference information item 450 could also be formed as a print on the opaque material layer. Likewise, it would be possible to store this information item in a hologram and/or in a chip, which may optionally likewise be integrated into the security document and which are not illustrated here for reasons of simplification. The Roman notation of the number 4, "IV", is only chosen here in order to indicate that this digit is stored in a non-direction-dependent manner through the lower side as a second information item 420.

Figure 3:
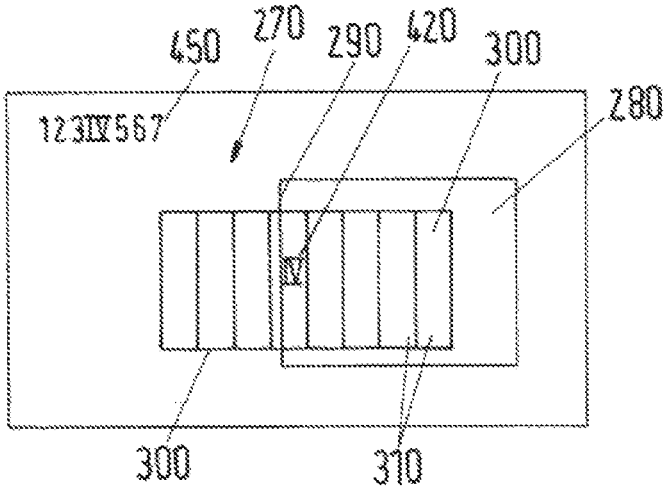
FIG. 3 shows a view from an observation direction through the upper side of the security object embodied as a security document.

FIG. 3 shows a view from another observation direction through the upper side of the security document, in a manner analogous to what was shown in FIG. 2. It can easily be identified that only the second information item and the reference information item 450 are registrable. The observation-direction-dependent first information item is not registrable from this registration or observation direction.

Figure 4:
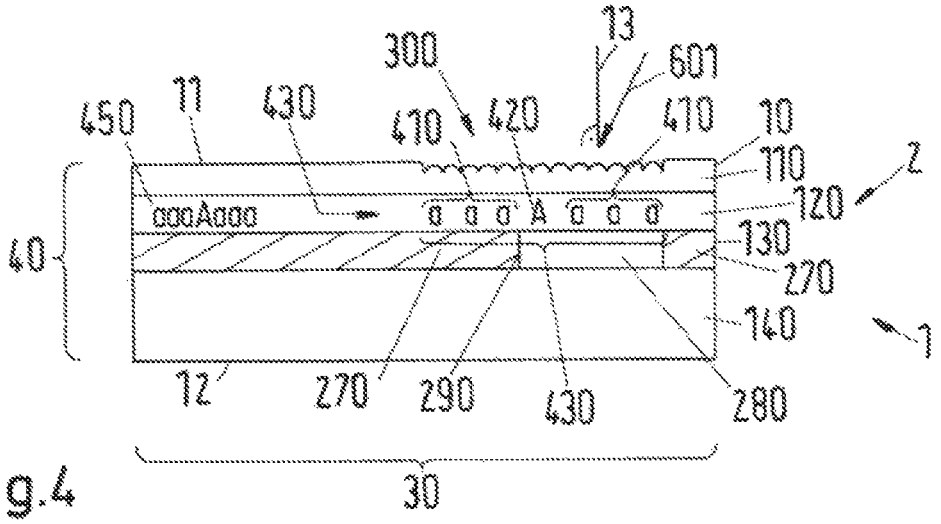
FIG. 4 shows a further embodiment of a security object embodied as a security document.

FIG. 4 shows a further embodiment of a security document 2 with a document body 10.

The same technical features have been provided with the same references.

In this embodiment, the second laser-capable material layer is missing, and so the second information item 420 is likewise stored into the first laser-capable material layer 120. Like in the embodiment according to FIGS. 1 and 2, this is implemented by radiating in focused laser light through the lower side 12 of the document body 10.

Figure 5:
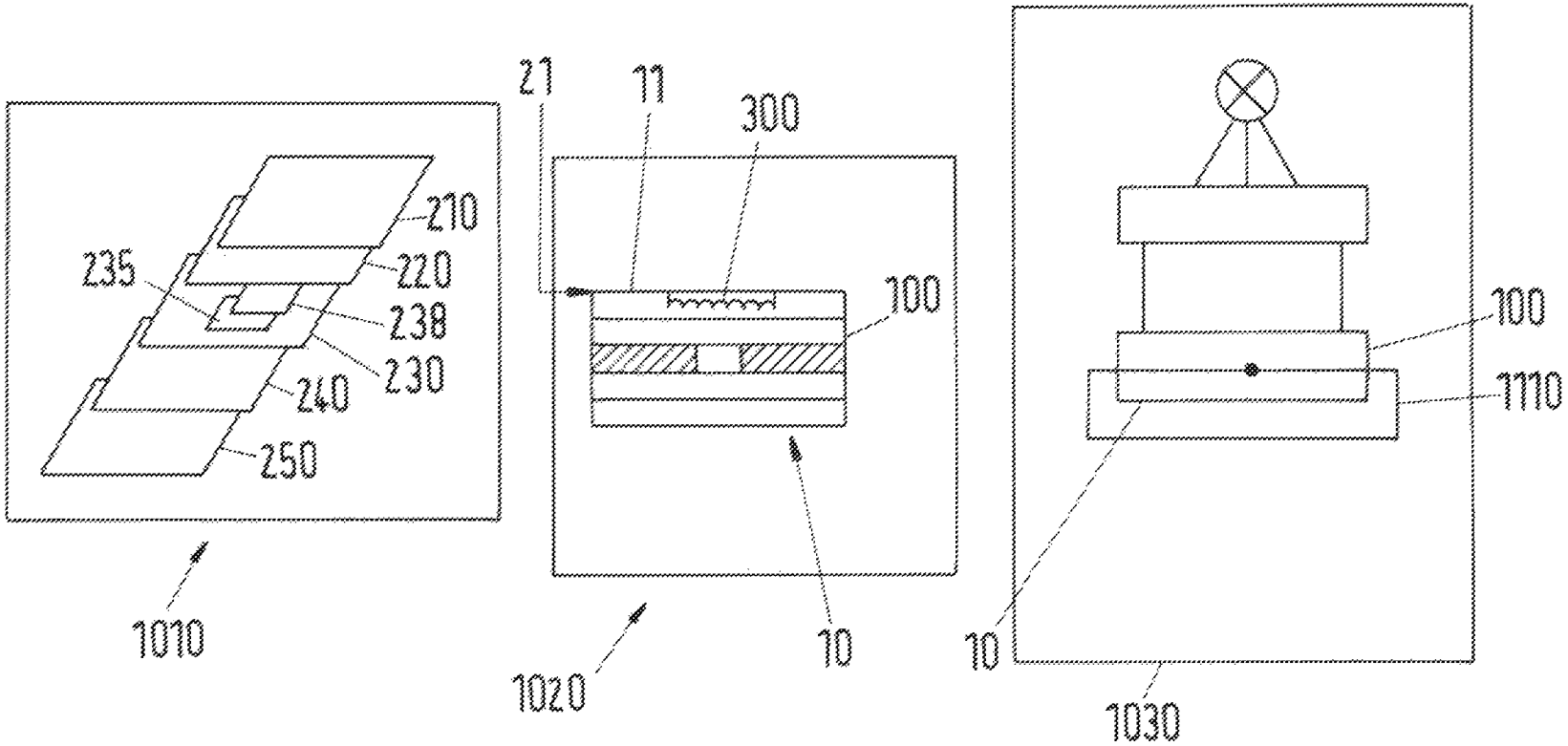
FIG. 5 shows an illustration of a schematic production of a security object.

FIG. 5 schematically illustrates the production of a security object 1 in the form of a document body 10 in the form of a lamination body 100. Initially, substrate layers 210 to 250, which correspond to the material layers 110 to 150 of the embodiment according to FIG. 1, are brought together. This means that a transparent substrate layer 250, a first laser-capable transparent substrate layer 220, an opaque substrate layer 230 with a cutout 235 and a transparent insert 238 that fills this cutout 235, a second laser-capable substrate layer 240 and a further transparent substrate layer 250 are brought together in a collection station 1010. In a high-pressure, high-temperature lamination method, the substrate layers 210 to 250 brought together thus are assembled in a lamination station 1020 to form a document body 10 that is formed as a lamination body 100. At the same time, or subsequently, the microlens array 300 is imprinted into the upper side 11 of the formed document body 10. Preferably, imprinting is carried out in such a way that the structuring of the microlenses does not protrude beyond an upper side plane 21 of the upper side 11, which is set by those portions of the upper side 11 in which the microlens array 300 has not been formed.

Such an embodiment protects the individual lens elements 310 of the microlens array 300 from damage.

Figure 6:
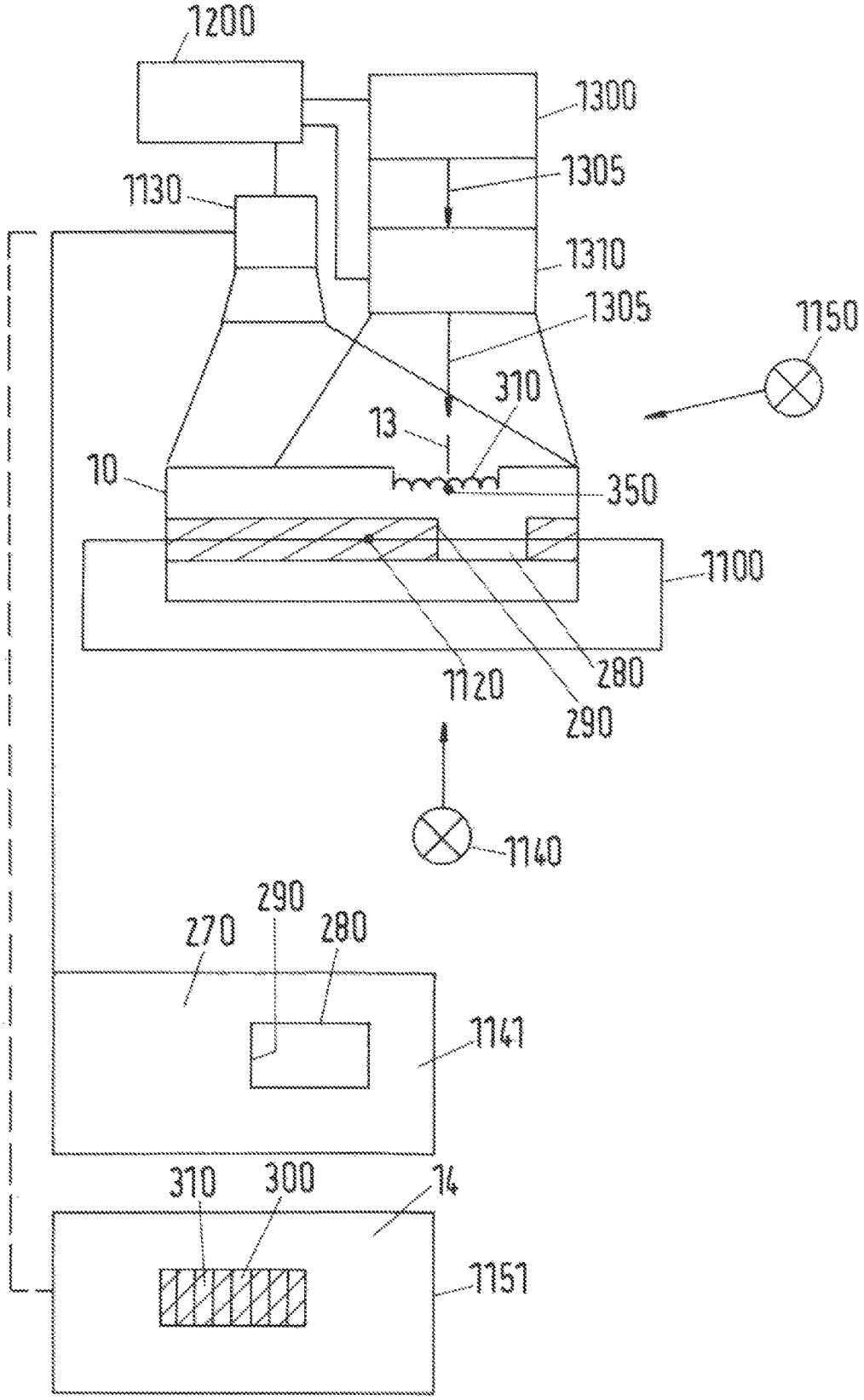
FIGS. 6, 6*a* show schematic illustrations of the situation for marking the first information item.

The lamination body 100 produced thus is subsequently brought into a marking apparatus 1030. In the latter, the document body 10 is held in a holder 1110. Marking is explained on the basis of FIG. 6.

The holder 1110 is pivotable about a pivot axis 1120. The document body 10 is arranged in the holder 1110 in such a way that the pivot axis 1120 is formed parallel to the directions of longitudinal extent of the lens elements 310, which are formed as cylindrical lenses, of the microlens array 300. Since the microlens array 300 is not necessarily formed centrally on the upper side of the document body 10, the pivot axis 1120, as a rule, does not coincide with a central axis 350 of the lens array. Moreover, slight manufacturing tolerances occur when forming the window portion and the relative positioning of the microlens array relative to the window portion and the portion boundary. For these reasons, it is necessary to establish a position of the portion boundary 290 or of the window portion 280 relative to the marking apparatus 1030 for the purposes of precisely marking the first information item and the second information item. To this end, the marking apparatus 1030 has a camera 1130. Arranged opposite thereto, there is a transmitted-light source 1140. The light of this transmitted-light source passes through the window portion 280 of the document body 10 and it is registered by the camera 1130. A captured view shows such a transmitted-light view 1141 of the document body 10. It is possible to clearly recognize the window portion 280 as a bright region and the reflected view portion 270 as a dark region. From this, it is possible to establish the exact position of the boundary portion 290, which need not necessarily extend along straight lines. In order to establish a position of the lens array 300 relative thereto, provision is made of a grazing-light light source 1150. A grazing-light view 1151 registered by the camera 1130 shows a clear contrast between the lens array 300 and the remaining surface 14 of the upper side. As a result of this, it is possible to likewise precisely determine the position of the lens array 300. The marking process is controlled by a control device 1200.

Figure 6A:
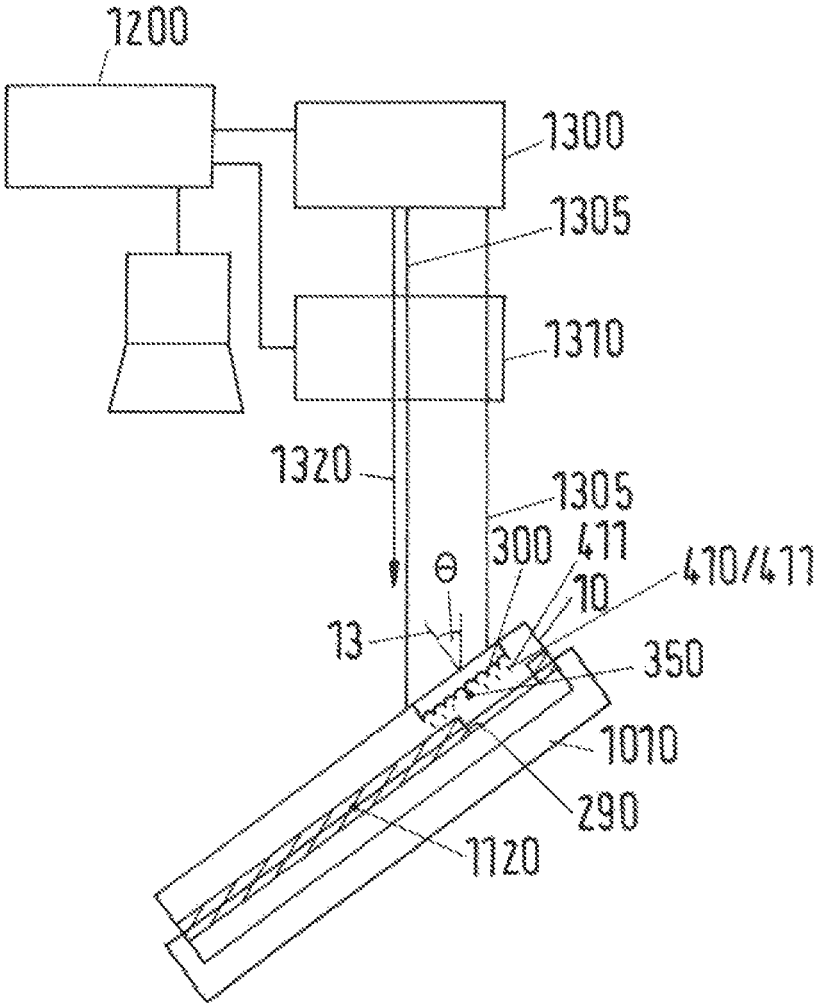

FIG. 6*a* schematically illustrates the situation for marking the first information item. As a rule, the first information item, which is stored for an observation direction dependence, is stored for a registration direction that does not coincide with a surface normal 13 of the upper side 11 of the document body 10. Therefore, the document body 10 in the holder 1110 is pivoted, as a rule, through an angle θ in relation to a light incidence direction 1320. Incident light 1305 of a marking light source 1300, which is formed as a laser light source, for example, is modulated in a spatial light modulator 1310 according to the first information item. As a result of this, the first information item is impressed onto the light. Light is passed through the spatial light modulator 1310 only at those locations at which an irreversible material change 411 should be caused in the security document; said light is blocked at other locations. Consequently, a graphic representation of the first information item that is decomposed into pixels arises. It can be formed both in black/white, or light/dark, and in grayscale levels or brightness levels. Since the document body is pivoted through the angle θ in relation to the light incidence direction 1320, it is necessary to calculate a distortion and position adaptation for the incoming radiation of the light for marking the first information item depending on the established position of the portion boundary 290 and, optionally, with an additional dependence on the position of the microlens array 300 and of the angle.

Figure 6B:
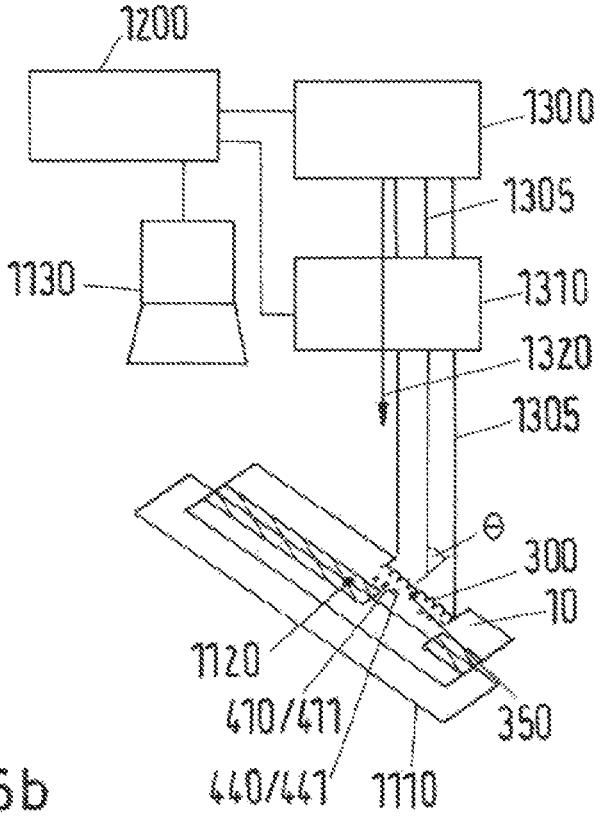
FIG. 6*b* shows a tilt of the document body through an angle $-\theta$ in relation to the light emergence direction with the upper side for marking a third information item.

In FIG. 6*b*, the document body 10 is tilted with the upper side through an angle −θ in relation to the light incidence direction. Preferably, a third information item is stored in the document body in this position. In the finished security document, there consequently are two observation-angle-dependent information items, the first information item 410 and the third information item 440, which are visible under different observation directions.

Figure 6C:
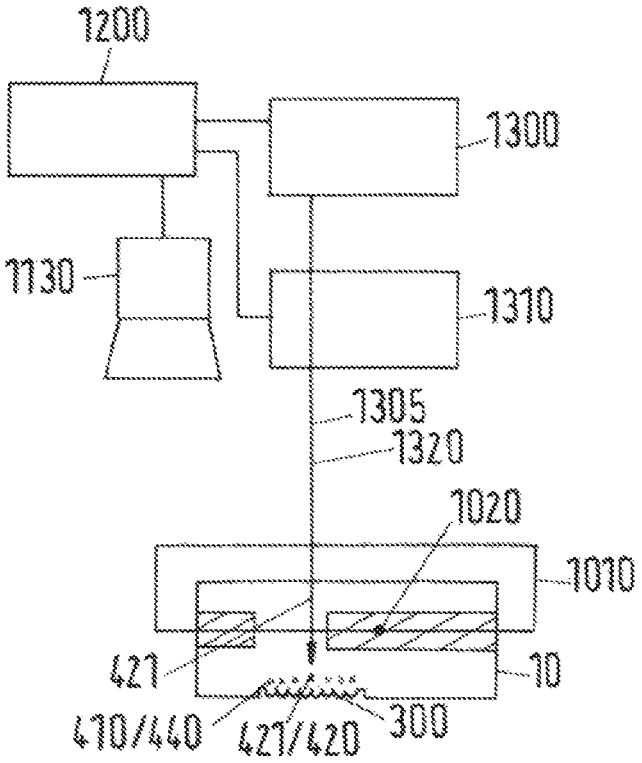
FIG. 6*c* shows a schematic illustration of the marking of the second information item.

In FIG. 6*c*, the document body is pivoted through 180° in relation to the light incidence direction such that marking is carried out through the lower side 12. In this position, the second information item 420 is introduced with a position fitted to the first information item 410 such that, preferably, the first information item and the second information item complement one another to form an overall information item. The third information item can likewise be formed in such a way that it complements the second information item to form a further overall information item. Preferably, the overall information item and the further overall information item are printed, e.g., as a printed information item, for example on the substrate layer 230 (see FIG. 4) prior to the lamination, and can thus serve as reference information item and further reference information item, which are identifiable as a print on the material layer 130 in the finished document body 10.

Figure 7A:
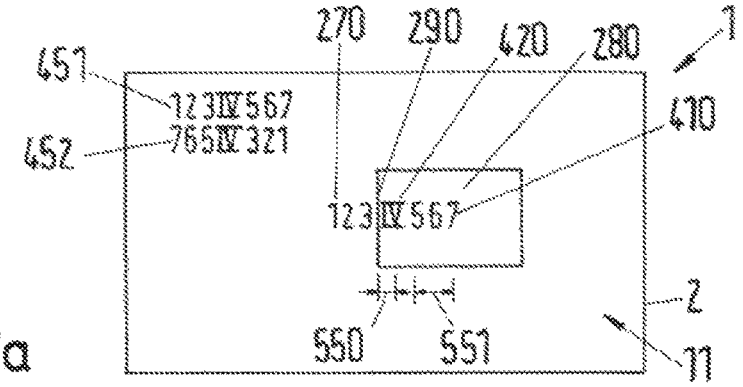
FIGS. 7*a* to 7*d* show schematic views of the security object embodied as a security document.

FIGS. 7*a* to 7*d* schematically illustrate views of a security object 1 embodied as a security document 2, which was produced according to the method described above. When observing the document body 10 at the angle θ in relation to the surface normal 13 of the security document, the first information item 410, "123 567", is registrable together with the second information item 420, "IV". This is shown in FIG. 7*a*. Additionally, the first reference information item 451, "123IV567", and the second reference information item 452, "765IV321", are registrable. If the first and the second information item 410, 420 are not precisely positioned in relation to one another, this is visible to an observer. As a rule, manipulations carried out on the first or the second information item, or a separation of the document body and subsequent re-lamination thereof, lead to deviations in the relative positioning, and so such manipulations are easily identifiable. A boundary distance 550 of the second information item 420 from the boundary portion 290 is preferably less than a character length 551 of the character string of the first information item 410.

Figure 7B:
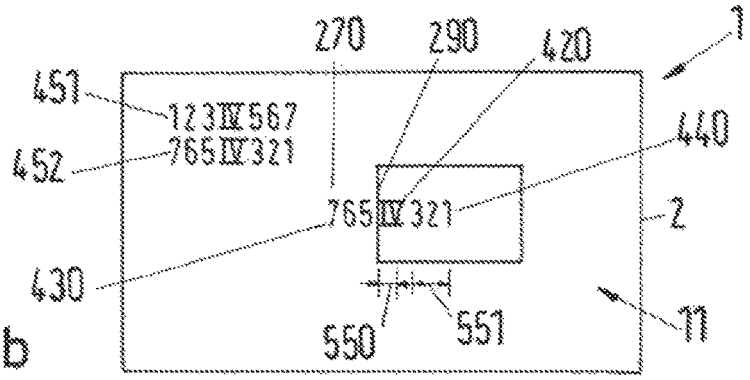

FIG. 7*b* illustrates the view at an observation direction −θ in relation to the surface normal. It is possible to recognize the third information item 440, "765 321", together with the second information item 420, "IV", and, once again, the reference information items 451, 452.

Figure 7C:
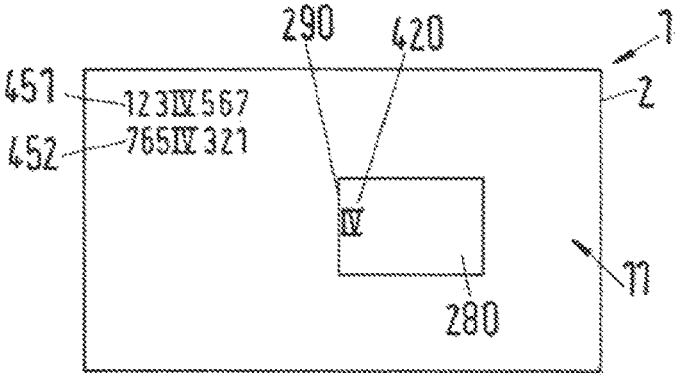
Figure 7D:
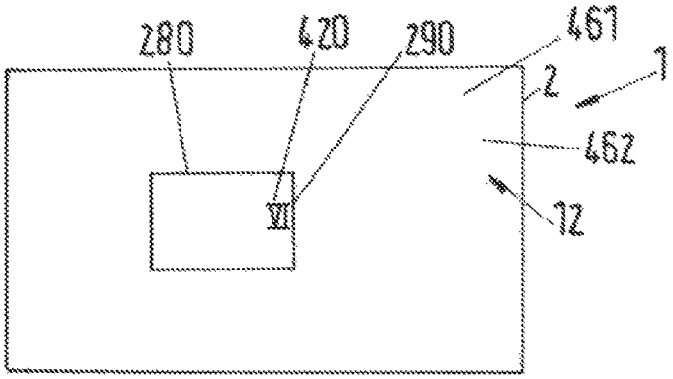

FIG. 7*c* shows a perpendicular plan view of the security document 2. From this observation direction, it is only possible to identify the second information item 420, "IV", together with the reference information items 451, 452. In the case of an observation through the lower side 12, which is illustrated in FIG. 7*d*, it is only possible to recognize the second information item 420 in a mirror-inverted manner, "VI". The reference information items cannot be identified in the case of an observation from this lower side 12 since the opaque material layer prevents a view through the document body 10 at those locations 461, 462 at which the reference information items should be identifiable.

A person skilled in the art understands that only exemplary embodiments have been described. The individual examples described in the various embodiments can be combined with one another. Preferably, the first and the second information item are additionally linked from an information technology point of view; by way of example, the second information item may represent a checksum or digit sum of the alphanumeric characters of the first information item. The third information item can be chosen in the same manner and it can be linked to the second information item in the same way. However, fitting to the third information item, a fourth information item, which likewise through the lower side of the document body as a static information item stored by way of irreversible changes, may also be linked in an alternative manner.

REFERENCE SIGNS

1 Security object
2 Security document
10 Document body
11 Upper side
12 Lower side
13 Surface normal
14 Remaining surface
21 Upper-side plane
22 Lower-side plane
30 Edge length
40 Document body thickness/upper side-lower side distance
50 Plan view
100 Lamination body
110 Transparent material layer
120 First laser-capable material layer
130 Opaque material layer
135 Cutout
136 Transparent material
140 second laser-capable material layer
150 Transparent material layer
210 Transparent substrate layer
220 First laser-capable substrate layer
230 Opaque substrate layer
235 Cutout
236 Transparent substrate
238 Insert
240 Second laser-capable substrate layer
250 Transparent substrate layer
270 Reflected view portion
280 Window portion
290 Portion boundary
300 Microlens array
310 Microlenses
320 A part
330 Another part
350 Center axis
410 First information item
411 First irreversible material changes, "a"
412 Alphanumerical characters
413 Mean character width
415 Constituent part of the first information item, which is stored in the window portion
416 Constituent part of the first information item, which is stored in the reflected view portion
420 Second information item

421 Second irreversible material changes
430 Overall information item
440 Third information item
441 Third irreversible material changes
450 Reference information item
451 First reference information item
452 Second reference information item
461 Location at which the first reference information item should be identifiable
462 Location at which the second reference information item should be identifiable
525 Boundary distance
601 An (observation/marking) direction
602 Further (observation/marking) direction
611 View from the one observation direction
612 Further view from the further observation direction
641 View through the lower side
1010 Collection station
1020 Lamination station
1030 Laser marking station
1110 Holder
1120 Pivot axis
1130 Camera
1140 Transmitted-light light source
1141 Transmitted-light view
1150 Grazing-light source
1151 Grazing-light view
1200 Control device
1300 Marking light source
1305 Light
1310 Spatial light modulator
1320 Light incidence direction/marking direction

The invention claimed is:

1. A security object, comprising:

a document body being a laminated body formed from various material layers and having a planar extent with an upper side and a lower side opposite said upper side;

a lens array formed at or in said upper side of said document body;

a laser-marked and observation-direction-dependent first information item stored in said document body by way of first irreversible material changes in said document body, an optical observability of the first information item through said lens array depending on an observation direction;

said document body having a reflected view portion, in said reflected view portion, said document body having between said upper side and said lower side of said document body a translucent or opaque material layer;

said document body having a window portion adjoining said reflected view portion, in said window portion said document body is formed from material that is transparent in volume, in a region of said window portion, all of said various materials layers disposed above said window portion and disposed below said window portion are embodied as being transparent;

said lens array extending over both at least part of said window portion and at least part of said reflected view portion and, as a result thereof, bridges a portion boundary between said reflected view portion and said window portion;

said laser-marked and observation-direction-dependent first information item is embodied partly in said reflected view portion and partly in said window portion; and a laser-marked second information item stored in said window portion by way of second irreversible material changes in said document body, said laser-marked second information item is observable optically as an information item both through said lens array at or in said upper side of said document body and through said lower side of said document body.

2. The security object according to claim 1, wherein the first information item and the second information item form an overall information item.

3. The security object according to claim 2, wherein the overall information item is stored in said document body as a reference information item, in addition to the first and second irreversible material changes.

4. The security object according to claim 1, wherein at least part of the second information item is stored immediately adjacent to said portion boundary.

5. The security object according to claim 2, wherein the overall information item contains a meaning, said meaning not being represented completely graphically by either the first information item or the second information item.

6. The security object according to claim 1, wherein said document body has a first laser-sensitive transparent material layer, in which said first irreversible material changes are formed, and is formed between said upper side and said translucent or opaque material layer.

7. The security object according to claim 6, wherein said document body has a second laser-sensitive transparent material layer, which is formed between said first laser-sensitive transparent material layer and said lower side and in which the second irreversible material changes are formed.

8. The security object according to claim 7, wherein said second laser-sensitive transparent material layer is disposed between said lower side and said translucent or opaque material layer.

9. The security object according to claim 1, wherein said translucent or opaque material layer is formed from a translucent or opaque substrate layer, which has a cutout in a region of said window portion, said cutout being filled with a transparent material.

10. A method for producing a security object, which comprises the steps of:

providing or producing a document body with a planar extent, the document body having an upper side and a lower side opposite said upper side;

forming a lens array at or in the upper side;

storing a laser-marked and observation-direction-dependent first information item by virtue of spatially modulated laser light being radiated through the lens array from one direction and first irreversible material changes being caused in focal regions of lenses of the lens array;

forming the document body with a reflected view portion, in the reflected view portion the document body having a translucent or opaque material layer between the upper side and the lower side of the document body;

forming the document body with a window portion adjoining the reflected view portion, the document body being formed in the window portion from material that is transparent in volume between the upper side and the lower side of the document body, wherein the lens array extending over both at least part of the window portion and at least part of the reflected view portion and, as a result thereof, bridges a portion boundary between the reflected view portion and the window portion;

implementing the storing of the laser-marked and observation-direction-dependent first information item in such a way that the laser-marked and observation-direction-dependent first information item is formed partly in the reflected view portion and partly in the window portion; and radiating further spatially modulated laser light into the window portion through the lower side and a second information item is laser-marked and stored in the document body by way of second irreversible material changes, wherein the second information item is observable optically as an information item both through the lens array at or in the upper side of the document body and through the lower side of the document body.

11. The method according to claim 10, which further comprises selecting the second information item in such a way that it the first information item and the second information item together form an overall information item, the overall information item having a meaning which is not represented completely graphically by either the first information item or the second information item.

12. The method according to claim 10, which further comprises forming the document body at least partly as a laminated body by virtue of a plurality of substrate layers being brought together into a substrate layer stack and being connected in planar fashion to one another in a lamination step by an introduction of energy, wherein, in the substrate layer stack, a substrate layer that is translucent or opaque in volume is formed or arranged, the substrate layer forming the translucent or opaque material layer of the document body, wherein the substrate layer that is translucent or opaque in volume has a cutout in a region that corresponds to the window portion, the cutout being filled with a transparent material before or during the lamination step.

13. The method according to claim 12, which further comprises imprinting the lens array into the upper side of the laminated body by means of a lamination stamp during the lamination step.

14. The method according to claim 10, wherein an incoming beam direction of the spatially modulated laser light is implemented by way of a rotation of the document body relative to a principal optical axis of the spatially modulated laser light.

15. The method according to claim 10, wherein a position of the portion boundary between the window portion and the reflected view portion is established relative to a marking apparatus and a spatial modulation and/or positioning of an incoming radiation of a first laser light is implemented in dependence on an established position of the portion boundary.

16. The method according to claim 10, which further comprises registering and evaluating a transmitted-light image of the window portion for establishing a position of the portion boundary.

17. The method according to claim 15, which further comprises determining a position of the lens array by virtue of a grazing-light recording of the upper side of the document body being registered and evaluated, and the position of the lens array relative to a position of the portion boundary is also taken into account when implementing modulation of the first laser light and/or the positioning of the first laser light.

* * * * *